US009021727B2

(12) United States Patent
Butler

(10) Patent No.: US 9,021,727 B2
(45) Date of Patent: May 5, 2015

(54) RECOIL PADS INCLUDING GAS CHAMBERS, FIREARMS INCLUDING SUCH RECOIL PADS, AND RELATED METHODS

(71) Applicant: Lawrence V. Butler, Hailey, ID (US)

(72) Inventor: Lawrence V. Butler, Hailey, ID (US)

( * ) Notice: Subject to any disclaimer, the term of this patent is extended or adjusted under 35 U.S.C. 154(b) by 50 days.

(21) Appl. No.: 13/740,742

(22) Filed: Jan. 14, 2013

(65) Prior Publication Data

US 2014/0196336 A1 Jul. 17, 2014

(51) Int. Cl.
*F41C 23/08* (2006.01)
*F41C 23/06* (2006.01)

(52) U.S. Cl.
CPC *F41C 23/08* (2013.01); *F41C 23/06* (2013.01)

(58) Field of Classification Search
CPC ..... F41C 23/06; F41C 23/08; F41C 23/10; F41C 23/20
USPC ..... 42/70.01, 71.02, 72, 73, 74
See application file for complete search history.

(56) References Cited

U.S. PATENT DOCUMENTS

| | | | | | |
|---|---|---|---|---|---|
| 460,142 | A | | 9/1891 | Leiding | |
| 488,855 | A | * | 12/1892 | Day | 42/74 |
| 544,269 | A | * | 8/1895 | Winters | 42/74 |
| 779,461 | A | * | 1/1905 | Benton | 42/74 |
| 837,455 | A | * | 12/1906 | Duncan | 42/74 |
| 1,123,180 | A | * | 12/1914 | Townsend | 42/74 |
| 1,209,726 | A | * | 12/1916 | Krueger | 42/74 |
| 2,438,142 | A | * | 3/1948 | Brower | 42/74 |
| 3,484,977 | A | * | 12/1969 | Younts | 42/74 |
| 4,242,824 | A | * | 1/1981 | Pachmayr et al. | 42/71.02 |
| 4,683,671 | A | | 8/1987 | Farrar | |
| 4,887,374 | A | | 12/1989 | Santarossa | |
| 4,922,641 | A | | 5/1990 | Johnson | |
| 4,956,932 | A | * | 9/1990 | Cupp | 42/74 |
| 4,998,367 | A | * | 3/1991 | Leibowitz | 42/71.02 |
| 5,014,358 | A | * | 5/1991 | Matumori | 2/94 |
| 5,235,765 | A | | 8/1993 | Chesnut | |
| 5,265,366 | A | | 11/1993 | Thompson | |
| 5,461,813 | A | * | 10/1995 | Mazzola | 42/74 |
| 5,471,776 | A | * | 12/1995 | Chesnut et al. | 42/74 |
| 5,634,289 | A | | 6/1997 | Wascher | |
| 5,669,168 | A | | 9/1997 | Perry | |
| 6,305,115 | B1 | | 10/2001 | Cook | |
| 6,311,423 | B1 | * | 11/2001 | Graham | 42/74 |
| D460,142 | S | | 7/2002 | West | |
| 6,467,212 | B1 | * | 10/2002 | Apel | 42/74 |
| 6,588,023 | B1 | | 7/2003 | Wright | |
| 6,834,456 | B2 | | 12/2004 | Murello | |
| 6,889,461 | B2 | | 5/2005 | Vignaroli et al. | |

(Continued)

OTHER PUBLICATIONS

PCT International Search Report and Written Opinion for PCT Application No. PCT/US2013/077811, mailed Apr. 18, 2014.

*Primary Examiner* — Bret Hayes
*Assistant Examiner* — Derrick Morgan
(74) *Attorney, Agent, or Firm* — TraskBritt

(57) ABSTRACT

A recoil pad for a firearm includes at least one gas chamber, and at least one access port to the gas chamber. The access port retains gas pressure within the gas chamber, and also allows pressurization and depressurization of the gas chamber. In additional embodiments, a recoil pad encloses two or more gas chambers having different pressures therein. Firearms include such recoil pads. Methods of fabrication of firearms include attaching such a recoil pad to a stock or grip of a firearm. Methods of using such recoil pads and firearms include the selective pressurization or depressurization of a gas chamber in a recoil pad.

16 Claims, 5 Drawing Sheets

(56) References Cited

U.S. PATENT DOCUMENTS

| | | | | |
|---|---|---|---|---|
| 7,121,032 | B2 | 10/2006 | Daul et al. | |
| 8,713,716 | B2 * | 5/2014 | Krueger | 2/412 |
| 2001/0011434 | A1 * | 8/2001 | Gussalli Beretta | 42/74 |
| 2003/0226304 | A1 | 12/2003 | Murello | |
| 2004/0144011 | A1 | 7/2004 | Vignaroli et al. | |
| 2005/0115134 | A1 * | 6/2005 | Bond et al. | 42/74 |
| 2006/0032102 | A1 * | 2/2006 | Sims | 42/74 |
| 2006/0168869 | A1 * | 8/2006 | Daul et al. | 42/74 |
| 2006/0254112 | A1 * | 11/2006 | Snoderly | 42/74 |
| 2011/0302817 | A1 | 12/2011 | deBrun et al. | |
| 2012/0167432 | A1 * | 7/2012 | Howe et al. | 42/74 |

* cited by examiner

RECOIL PADS INCLUDING GAS CHAMBERS, FIREARMS INCLUDING SUCH RECOIL PADS, AND RELATED METHODS

TECHNICAL FIELD

The present disclosure relates to a recoil pad configured for use on a firearm to absorb recoil force experienced upon firing the firearm, to a firearm carrying such a recoil pad, and to methods of making and using such a recoil pad and firearm.

BACKGROUND

A shoulder firearm is a firearm having a firing mechanism and an associated firing chamber, a barrel extending in the forward direction from the firing mechanism and firing chamber, and what is referred to as a "stock" extending in the rearward direction from the firing mechanism. The stock is configured to abut against the shoulder of a person firing the firearm, and is used to assist in supporting and steadying the firearm while aiming and firing the firearm. Shoulder firearms include, for example, rifles, shotguns, muzzleloaders, etc.

Upon firing ammunition from a firearm, the forces generated by the exploding gun powder force the bullet or other projectile(s) in the forward direction through the barrel, but also force the firearm in the opposite, backward direction toward the body of the person firing the firearm. The force acting on the firearm in the backward direction is referred to in the art as the "recoil force," and the movement of the firearm in the backward direction responsive to the recoil force is referred to simply as "recoil."

Recoil forces of a shoulder firearm can be significant enough to cause pain and/or injury (e.g., bruising) to a person firing the shoulder firearm, especially when using ammunition having relatively high firing power and/or when firing numerous rounds of ammunition over a relatively short period of time. It is known in the art to provide what is referred to in the art as a "recoil pad" on the end surface of the stock of a shoulder firearm in an effort to reduce such pain and injury. Recoil pads are commonly formed of a material, such as rubber, that is softer and more flexible than the material of the stock, which usually comprises wood, metal, or a relatively rigid polymeric material.

BRIEF SUMMARY

This summary is provided to introduce a selection of concepts in a simplified form. These concepts are described in further detail in the detailed description of example embodiments of the disclosure below. This summary is not intended to identify key features or essential features of the claimed subject matter, nor is it intended to be used to limit the scope of the claimed subject matter.

In some embodiments, the present disclosure includes a recoil pad configured to be attached to a firearm. The recoil pad includes an elastomeric body enclosing at least one gas chamber, and at least one access port extending through a wall of the elastomeric body to the at least one gas chamber. The at least one access port is configured to retain gas pressure within the at least one gas chamber of the recoil pad, and to allow selective pressurization and depressurization of the at least one gas chamber by moving gas into and out from the at least one gas chamber through the at least one access port.

In additional embodiments, the present disclosure includes a recoil pad configured to be attached to a shoulder firearm, in which the recoil pad includes an elastomeric body enclosing at least a first gas chamber and a second gas chamber. A first gas pressure within the first gas chamber is different from a second gas pressure within the second gas chamber.

In yet further embodiments, the present disclosure includes a firearm having a stock or grip extending from a firing mechanism. The shoulder firearm further includes a recoil pad disposed on the stock or grip. The recoil pad has an elastomeric body enclosing at least one gas chamber and having at least one access port extending through a wall of the elastomeric body to the at least one gas chamber. The at least one access port is configured to retain gas pressure within the at least one gas chamber of the recoil pad during use of the firearm, and to allow selective pressurization and depressurization of the at least one gas chamber by moving gas into and out from the at least one gas chamber through the at least one access port.

In additional embodiments, the present disclosure includes a firearm having a stock or grip extending from a firing mechanism. The firearm further includes a recoil pad disposed on the stock or grip. The recoil pad includes an elastomeric body enclosing at least a first gas chamber and a second gas chamber. A first gas pressure within the first gas chamber is different from a second gas pressure within the second gas chamber.

In additional embodiments, the present disclosure includes a method of manufacturing a recoil pad for attachment to a stock or grip of a firearm. In accordance with the method, an elastomeric body is formed that encloses at least one gas chamber, and at least one access port is provided that extends through a wall of the elastomeric body to the at least one gas chamber. The at least one access port is configured to retain gas pressure within the at least one gas chamber of the recoil pad, and to allow selective pressurization and depressurization of the at least one gas chamber by moving gas into and out from the at least one gas chamber through the at least one access port.

In further embodiments, the present disclosure includes a method of manufacturing a recoil pad for attachment to a stock or grip of a firearm. In accordance with the method, an elastomeric body is formed that encloses at least a first gas chamber and a second gas chamber. The first gas chamber is pressurized to a first gas pressure, and the second gas chamber is pressurized to a second gas pressure different from the first gas pressure in the first gas chamber.

In yet additional embodiments, the present disclosure includes a method of using a firearm. In accordance with the method, at least one gas chamber within a recoil pad on a stock or grip of a firearm is selectively pressurized or depressurized. The recoil pad is abutted against a body of a person, and the firearm is then fired.

DETAILED DESCRIPTION

The illustrations presented herein are not meant to be actual views of any particular recoil pad, firearm, or component thereof, but are merely idealized representations that are used to describe embodiments of the disclosure.

As used herein, the term "proximal," when used in relation to a firearm or a component of a firearm, means proximate or nearer to the body of a person firing the firearm. As used herein, the term "distal," when used in relation to a firearm or a component of a firearm, means remote or farther from the body of a person firing the firearm.

Figure 1:
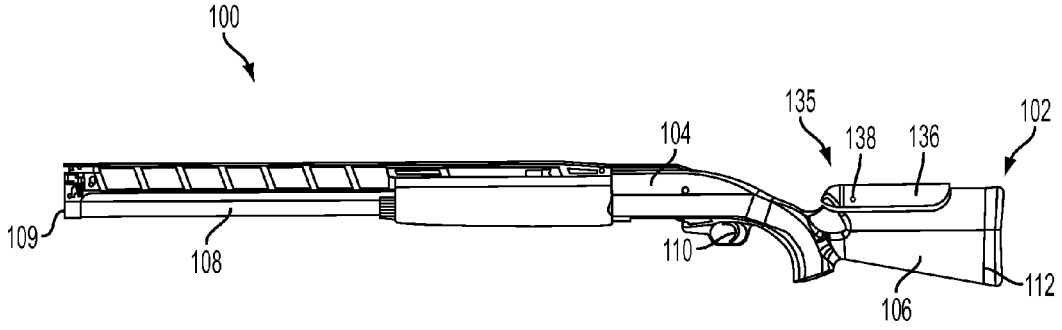
FIG. 1 is a perspective view of a shoulder firearm that includes a recoil pad as described herein.

FIG. 1 illustrates an example of a shoulder firearm 100 that includes a recoil pad 102 having one or more gas chambers therein, as described in further detail below. In some embodiments, the gas pressure within the one or more gas chambers may be selectively adjusted by a user. In some embodiments, the recoil pad 102 may include two or more gas chambers, and the gas pressure in at least one gas chamber may differ from the gas pressure in at least one other gas chamber. In other embodiments, the gas pressure in the gas chambers may be the same.

The shoulder firearm 100 illustrated in FIG. 1 comprises a shotgun that is configured to fire shotshell type ammunition, although the shoulder firearm 100 may comprise any type of shoulder firearm in other embodiments. For example, the firearm 100 may comprise a rifle or a muzzle loader in other embodiments. The shoulder firearm 100 includes a central body 104 comprising a firing mechanism, a stock 106, and a barrel 108. The central body 104 has a firing chamber therein, as well as a firing mechanism for firing ammunition within the firing chamber. The firing mechanism includes a trigger 110 and associated components, such as a firing pin or a hammer, which will depend upon the type of the firearm 100. The stock 106 extends proximally from the central body 104 of the firearm 100 toward the body of a person using the firearm 100. The barrel 108 extends distally from the central body 104 of the firearm 100 away from the body of a person using the firearm 100.

The stock 106 has a proximal end 112 that is configured to abut against a shoulder of a person firing the shoulder firearm 100. As previously mentioned, the stock 106 may be used to assist in supporting and steadying the firearm while aiming and firing the firearm 100. The stock 106 may comprise a rigid material such as wood, metal, or a rigid polymeric material.

The recoil pad 102 is disposed on the proximal end 112 of the stock 106, such that the recoil pad 102 is disposed between the shoulder of a person firing the firearm and the proximal end 112 of the stock 106. The recoil pad 102 may be used to reduce (e.g., eliminate) pain and injury that might result from the recoil forces generated upon firing the shoulder firearm 100.

Figure 2:
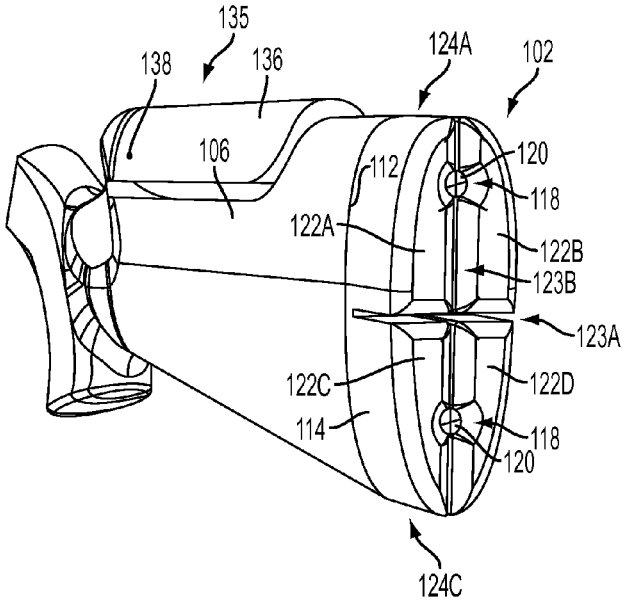
FIG. 2 is a perspective view of a portion of the shoulder firearm of FIG. 1 and illustrates the recoil pad attached to an end of the stock of the shoulder firearm.
Figure 3:
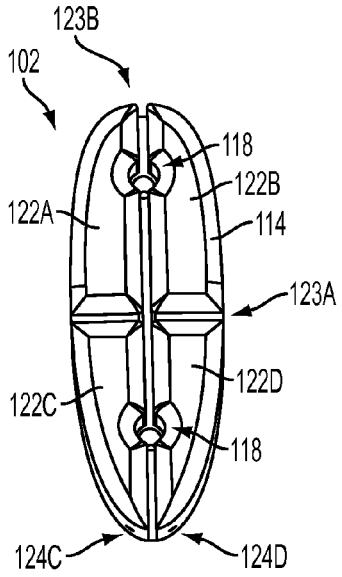
FIG. 3 is a plan view of a back side of the recoil pad, which is the side configured to abut against the shoulder of a person using the recoil pad on a shoulder firearm.
Figure 4:
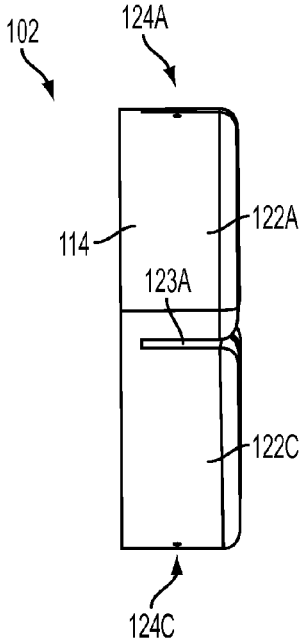
FIG. 4 is a plan view of a left side of the recoil pad.
Figure 5:
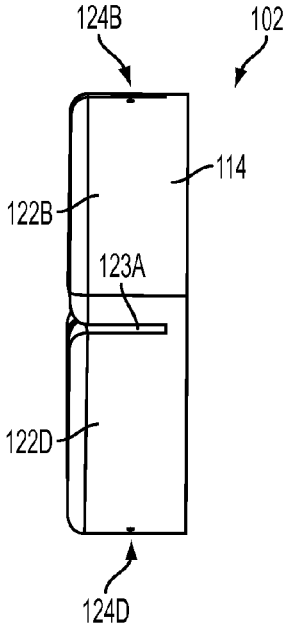
FIG. 5 is a plan view of a right side of the recoil pad.
Figure 6:
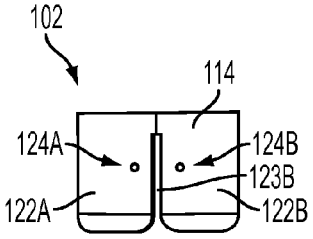
FIG. 6 is a plan view of a top side of the recoil pad.
Figure 7:
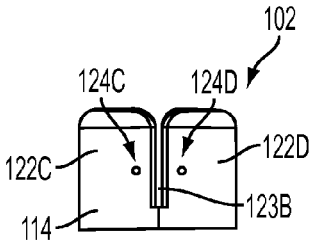
FIG. 7 is a plan view of a bottom side of the recoil pad.

FIG. 2 is an enlarged view of the recoil pad 102 mounted on the proximal end 112 of the stock 106. The recoil pad 102 includes an elastomeric body 114 enclosing at least one gas chamber 132 (see FIGS. 8 and 9) therein. The recoil pad 102 optionally may be configured to allow repeated attachment to and detachment from, the proximal end 112 of the stock 106. For example, the recoil pad 102 may include one or more holes 118 extending through the elastomeric body 114, and one or more corresponding fasteners, such as screws 120, may be inserted through the holes 118 and into the proximal end 112 of the stock 106. The screws 120 may include threads that engage internal surfaces of the stock 106 in such a manner as to prevent retraction of the screws 120 out from the stock 106 without deliberate rotation of the screws 120. In other embodiments, the recoil pad 102 may be permanently attached to the proximal end 112 of the stock 106 using, for example, an adhesive, and may not include any holes for receiving fasteners (e.g., screws 120).

The elastomeric body 114 of the recoil pad 102 includes an upper left first region 122A enclosing a first gas chamber, an upper right second region 122B enclosing a second gas chamber, a lower left third region 122C enclosing a third gas chamber, and a lower right fourth region 122D enclosing a fourth gas chamber. In other embodiments, the elastomeric body 114 may enclose only one, two, three, or more than four gas chambers. In some embodiments, the elastomeric body 114 may enclose five, six, seven, or eight gas chambers therein, for example.

The elastomeric body 114 may comprise a material that exhibits a relatively low modulus of elasticity and a relatively high yield strain. By way of example and not limitation, the elastomeric body 114 may comprise a rubber material such as polyisoprene, polybutadiene, polychloroprene, polystyrene, acrylonitrile, silicone, or a fluoropolymer, or a copolymer of two or more such materials.

The regions 122A-122D of the elastomeric body 114 that include the respective gas chambers may be isolated from one another, such that at least some degree of deformation of one of the regions 122A-122D will not cause deformation of others of the regions 122A-122D. For example, as shown in FIG. 2, the elastomeric body 114 may include a first horizontally oriented elongated recess 123A that extends partially or entirely through the elastomeric body 114 between the upper first and second regions 122A, 122B and the lower third and fourth regions 122C, 122D, and a second vertically oriented elongated recess 123B that extends partially or entirely through the elastomeric body 114 between the left first and third regions 122A, 122C and the right second and fourth regions 122B, 122D. In this configuration, the regions 122A-122D of the elastomeric body 114 are isolated from one another by the recesses 123A, 123B, and normal deformation of one of the regions 122A-122D during use of the recoil pad 102 generally will not cause deformation of others of the regions 122A-122D.

FIGS. 3 through 7 illustrate the recoil pad 102 separate from the remainder of the firearm 100 of FIGS. 1 and 2. The recoil pad 102 may further include at least one access port extending through a wall 126 (FIGS. 8 and 9) of the elastomeric body 114 to a gas chamber enclosed therein. The access port may be configured to retain gas pressure within the gas chamber of the recoil pad, and to also allow selective pressurization and depressurization of the at least one gas chamber by moving gas into and out from the gas chamber through the access port. For example, the recoil pad 102 may include a first access port 124A associated with the first gas chamber enclosed in the first region 122A, a second access port 124B associated with the second gas chamber enclosed in the second region 122B, a third access port 124C associated with the third gas chamber enclosed in the third region 122C, and a fourth access port 124D associated with the fourth gas chamber enclosed in the fourth region 122D.

Thus, in some embodiments, the recoil pad 102 may include two or more (e.g., four) discrete gas chambers, and each of the gas chambers may have respective access ports 124A-124D for independently selectively pressurizing and depressurizing each of the two or more discrete gas chambers.

During use, the gas pressure within the gas chambers may be increased to increase the stiffness of the recoil pad 102, or decreased to decrease the stiffness of the recoil pad 102. As a result, the stiffness of the recoil pad 102 may be selectively adjusted to the liking of the person using the firearm 100. In addition, pressure differentials may be provided between the gas pressures in the chambers to affect the behavior of the firearm 100 during firing, and in particular, the movement of the firearm, due to the recoil forces. For example, if a muzzle 109 of the barrel 108 of the firearm 100 raises due to recoil forces upon firing, the gas pressure in the upper gas chambers (the gas chamber in the first region 122A and the gas chamber in the second region 122B) may be increased to a pressure greater than the pressure in the lower gas chambers (the gas chamber in the third region 122C and the gas chamber in the fourth region 122D). As a result, the upper regions of the recoil pad 102 may be stiffer, and the lower regions of the recoil pad 102 may be more flexible, which may reduce the tendency of the muzzle to raise responsive to recoil forces upon firing the firearm 100. Alternatively, the lower regions of the recoil pad 102 may be rendered stiffer, and the upper regions of the recoil pad 102 may be rendered more flexible to reduce the tendency of the muzzle to drop responsive to recoil forces upon firing the firearm 100, although such movement is less common in firearms.

Similarly, if the muzzle 109 of the barrel 108 of the firearm 100 moves to the right due to recoil forces upon firing, the gas pressure in the right gas chambers (the gas chamber in the second region 122B and the gas chamber in the fourth region 122D) may be increased to a pressure greater than the pressure in the left gas chambers (the gas chamber in the first region 122A and the gas chamber in the third region 122C). As a result, the right half of the recoil pad 102 may be stiffer, and the left half of the recoil pad 102 may be more flexible, which may reduce the tendency of the muzzle 109 to move to the right responsive to recoil forces upon firing the firearm 100. Alternatively, the left regions of the recoil pad 102 may be rendered stiffer, and the right regions of the recoil pad 102 may be rendered more flexible to reduce the tendency of the muzzle 109 to move to the left responsive to recoil forces upon firing the firearm 100.

In other embodiments, the recoil pad 102 may include two or more gas chambers (e.g., two, three, four, etc.), but may not include any access ports 124A-124D. In other words, the gas chambers may be sealed gas chambers that cannot be selectively pressurized and depressurized by a user of the firearm 100. Further, a first gas pressure within a first gas chamber may be different from a second gas pressure within a second gas chamber. The gas pressures in the two or more gas chambers may be determined and set at the time of manufacture of the recoil pad 102, and each of the gas pressures may be greater than, less than, or equal to atmospheric pressure. The recoil pad 102 may be configured to reduce (e.g., minimize) muzzle movement due to recoil forces upon firing, as described above. As non-limiting examples, the upper regions of the recoil pad 102 may be stiffer than lower regions of the recoil pad 102 (due to higher gas pressure in one or more gas chambers in the upper regions), which may reduce the tendency of the muzzle 109 to raise responsive to recoil forces upon firing the firearm 100, and/or the right-hand regions of the recoil pad 102 may be stiffer than left hand regions of the recoil pad 102 (due to higher gas pressure in one or more gas chambers in the right hand regions)

Figure 8:
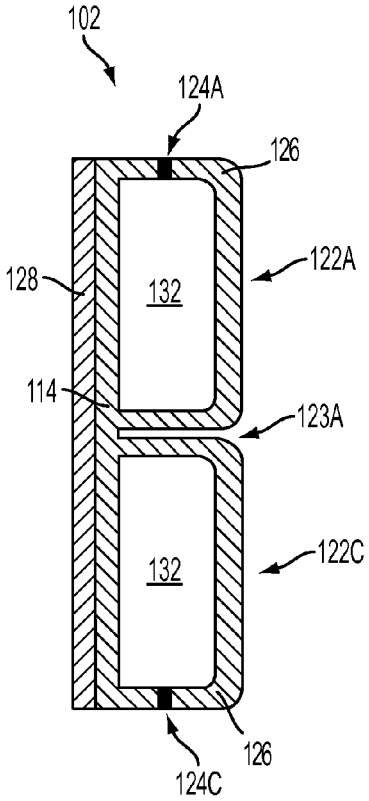
FIG. 8 is a simplified cross-sectional left side view of the recoil pad illustrating two gas chambers therein.

FIG. 8 is a cross-sectional view of the recoil pad 102. As shown in FIG. 8, the recoil pad 102 optionally may include a base plate 128 attached to the elastomeric body 114. The base plate 128 may comprise a material that is relatively rigid compared to the elastomeric body 114. For example, the base plate 128 may comprise a metal, wood, or a relatively rigid polymer material, such as a thermoplastic material or an epoxy material. The elastomeric body 114 may be attached to the base plate 128 using an adhesive, or the elastomeric body 114 may be formed around the base plate 128 using, for example, an injection molding process. The base plate 128 may be disposed on the side of the recoil pad 102 adjacent the stock 106. Thus, the exposed major surface of the recoil pad 102 on the side thereof adjacent the stock 106 may comprise a surface of the base plate 128. The base plate 128 may assist in attachment of the recoil pad 102 to the stock 106.

Figure 9:
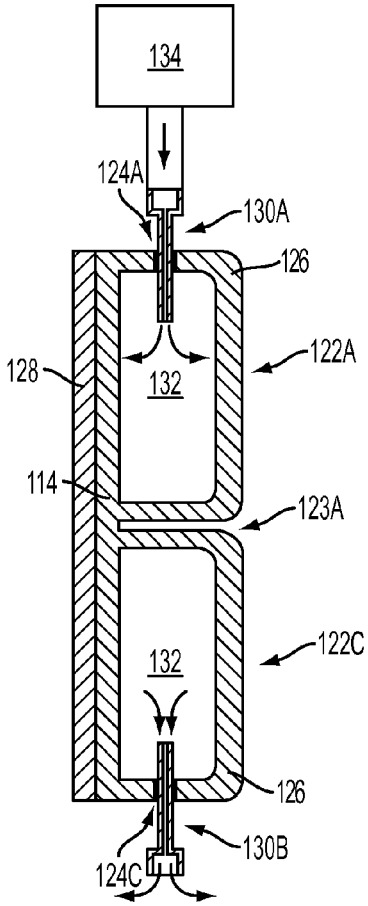
FIG. 9 is similar to FIG. 8 and illustrates a first tool being used to inflate one of the gas chambers in the recoil pad, and another tool being used to deflate one of the gas chambers.

FIG. 9 is similar to FIG. 8 and illustrates a first tool 130A being used to selectively pressurize a first gas chamber 132 within the first region 122A of the recoil pad 102, and a second tool 130B being used to selectively depressurize a third gas chamber 132 within the third region 122C of the recoil pad 102. The tools 130A, 130B may comprise, for example, an elongated needle that may be inserted through the access portions 124A, 124C and into the gas chambers 132. Each of the access ports 124A-124D may comprise a volume of elastomeric material having a hole that extends through the volume of elastomeric material. The volume of elastomeric material may be formed such that the hole is closed off when the tool is not disposed within the hole, so as to prevent gas within the gas chamber from passing through the hole to the exterior of the recoil pad 102, and to prevent gas outside the recoil pad 102 from passing through the hole and entering the gas chamber.

A gas pump 134 may be attached to the tool 130A to pump gas (e.g., air, nitrogen, argon, etc.) through the tool 130A and the first access port 124A and into the gas chamber 132 to increase the pressure within the first gas chamber 132. The tool 130B may not be attached to such a gas pump 134 when the tool 130B is inserted into the third gas chamber 132 so as to allow any pressurized gas within the gas chamber 132 to escape out from the gas chamber 132 to the exterior of the recoil pad 102 through the tool 130B and the access port 124C. Of course, any of the gas chambers within the recoil pad 102 may be selectively pressurized or depressurized as desirable using methods as described with reference to FIG. 9.

By providing a recoil pad 102 having a stiffness that may be selectively adjusted as described herein, one or more gas chambers within the recoil pad 102 may be selectively pressurized or depressurized. The recoil pad 102, while disposed on the end of the stock 106 of the firearm 100, may be abutted against the shoulder of a person and the person may fire the firearm 100. The gas pressure within the one or more gas chambers then may be increased or decreased to the liking of the person using the firearm 100, and the recoil pad 102 and the firearm 100 may again be abutted against the shoulder of the person and the firearm 100 may be fired.

Embodiments of firearms of the present disclosure, such as the shoulder firearm 100, may have one, two, three, or any number of recoil pads as described herein, such as the recoil pad 102, and such recoil pads may be provided at any location at which contact is made between a firearm and the body of a person using the firearm. For example, referring again to FIGS. 1 and 2, when a person is using a shoulder firearm, such as the shoulder firearm 100, the face (e.g., cheek) of the person using the firearm 100 may contact a portion of the stock 106, such as a comb 135 of the stock 106. Thus, in some embodiments, the firearm 100 may include a recoil pad 136 carried on the stock 106, such as on a comb 135 of the stock 106, at a location such that the face (e.g., cheek) of the person using the firearm may abut against the recoil pad 136 responsive to recoil upon firing the firearm 100. The recoil pad 136 may be configured as previously described in relation to the recoil pad 136, and may include one, two, or any number of gas chambers disposed within an elastomeric body. The recoil pad 136 may further include one or more access ports 138 located and configured to allow selective pressurization and depressurization of the at least one gas chamber within the recoil pad 136 by moving gas into and out from the gas chamber through the access port.

In some embodiments, the shoulder firearm 100 may include only the recoil pad 102, and not the recoil pad 136. In other embodiments, the shoulder firearm 100 may include only the recoil pad 136, and not the recoil pad 102. In yet further embodiments, the shoulder firearm 100 may include both the recoil pad 102 and the recoil pad 136.

Figure 10:
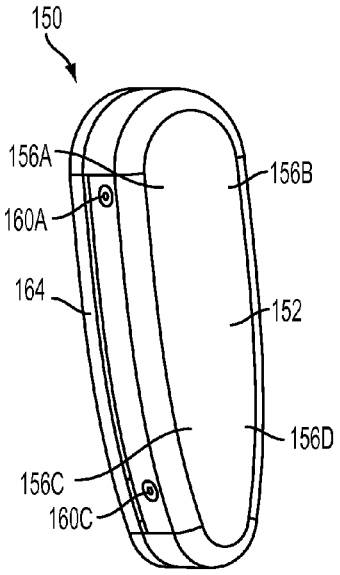
FIG. 10 is a front perspective view of another embodiment of a recoil pad of the present disclosure.
Figure 11:
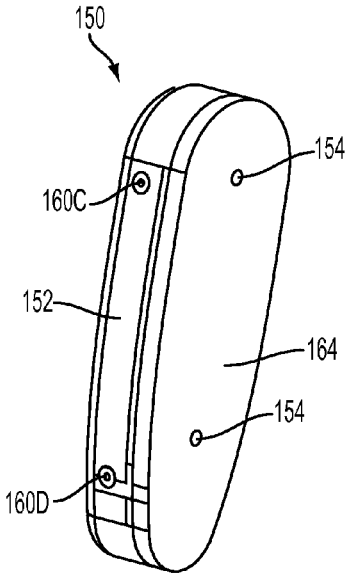
FIG. 11 is a back perspective view of the recoil pad of FIG. 10.
Figure 12:
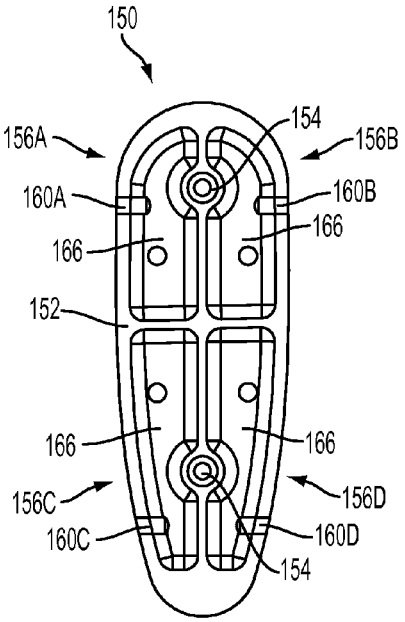
FIG. 12 is a cross-sectional plan view of the recoil pad shown in FIGS. 10 and 11, and illustrates four gas chambers therein.

FIGS. 10 through 12 illustrate an additional embodiment of a recoil pad 150 of the present disclosure. The recoil pad 150 is generally similar to the recoil pad 102 previously described herein, and comprises an elastomeric body 152 that includes four regions 156A-156D, each of which encloses a respective gas chamber 166. The four regions 156A-156D, however, are not separated from one another by any external recesses, such as the recesses 123A, 123B of the recoil pad 102. Each of the gas chambers 166 may have an associated access port 160A-160D, which may be used to pressurize and depressurize the respective gas chambers 166. In other embodiments, the recoil pad 150 may have less than four or more than four regions 156A-156D and associated gas chambers 166.

As shown in FIG. 12, the recoil pad 150 may include a base plate 164, similar to the base plate previously described herein, which may comprise a material that is relatively rigid compared to the material of the elastomeric body 152. The base plate 164 may include one or more holes 154 through which fasteners, such as screws or nails may extend for securing the recoil pad 150 to a proximal end of the stock of a shoulder firearm, such as the shoulder firearm 100 of FIG. 1.

Figure 13:
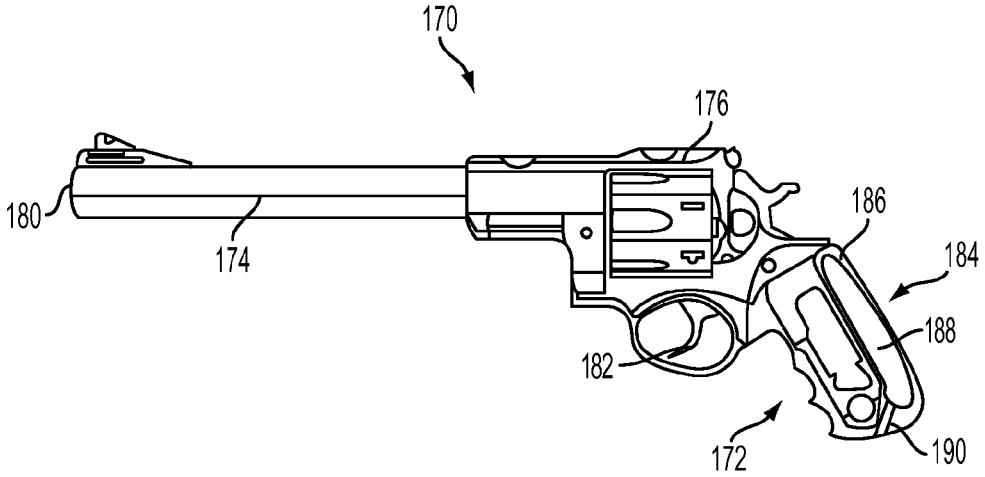
FIG. 13 is a partial, cross-sectional side view of a handgun firearm that includes another embodiment of a recoil pad of the present disclosure.

Although the recoil pads discussed previously herein are configured to be attached to an end of a stock of a shoulder firearm, in additional embodiments, recoil pads as described herein may be used with other types of firearms, such as handguns and other firearms that include a hand grip. For example, FIG. 13 is a partial cross-sectional side view of a handgun firearm 170. In the embodiment shown in FIG. 13, the handgun firearm 170 comprises a revolver in which multiple firing chambers are positioned in a rotating or revolving body. In other embodiments, the handgun firearm 170 may comprise a pistol, for example, in which the handgun firearm 170 comprises a single, stationary firing chamber. The handgun firearm 170 includes a central body 176 comprising a firing mechanism, and a handle grip 172 that extends from a proximal end of the central body 176. The handgun firearm 170 also includes a barrel 174 extending distally from the central body 176. The barrel 174 has a muzzle 180 at a distal end thereof from which bullets are projected upon firing. The firing mechanism carried by the central body 176 may include a trigger 182.

As shown in FIG. 13, the handgun firearm 170 also includes a recoil pad 184, which may be disposed on a proximal side of the handle grip 172. The recoil pad 184 includes an elastomeric body 186 that encloses a gas chamber 188. The recoil pad 184 may also include an access port 190 that may be used to selectively pressurize and depressurize the recoil pad 184, as desired by a person using the firearm, by introducing gas into the gas chamber 188 through the access port 190, or removing gas from the gas chamber 188 through the access port 190, in a manner like that previously described in relation to the recoil pad 102 of FIGS. 1 through 9. The elasticity of the elastomeric body 186, coupled with the gas chamber 188 contained therein, may be used to absorb recoil of the handgun firearm 170 upon firing. By selectively adjusting the pressure within the gas chamber 188, the response of the recoil pad 184 to the recoil of the firearm 170 may be selectively tailored to the preference of a person using the firearm 170.

Although the recoil pad 184 of the handgun firearm 170 of FIG. 13 has a single gas chamber 188 therein, in other embodiments, the recoil pad 184 may have more than one gas chamber 188 therein. Further, in additional embodiments, the gas chamber 188 therein may not include an associated access port 190, and may not be adjustable by a user. In such embodiments, the pressure within the gas chamber 188 may be tailored at the time of fabrication by the manufacturer of the recoil pad 184.

Additional non-limiting example embodiments of the disclosure are set forth below.

Embodiment 1: A recoil pad configured to be attached to a stock or grip of a firearm, the recoil pad comprising: an elastomeric body enclosing at least one gas chamber; and at least one access port extending through a wall of the elastomeric body to the at least one gas chamber, the at least one access port configured to retain gas pressure within the at least one gas chamber of the recoil pad and to allow selective pressurization and depressurization of the at least one gas chamber by moving gas into and out from the at least one gas chamber through the at least one access port.

Embodiment 2: The recoil pad of Embodiment 1, wherein the recoil pad includes two or more discrete gas chambers, each gas chamber of the two or more discrete gas chambers having a respective access port for independently selectively pressurizing and depressurizing each of the two or more discrete gas chambers.

Embodiment 3: The recoil pad of Embodiment 2, wherein the two or more discrete gas chambers comprise four discrete gas chambers.

Embodiment 4: The recoil pad of any one of Embodiments 1 through 3, wherein the recoil pad includes a base plate attached to the elastomeric body.

Embodiment 5: A recoil pad configured to be attached to a stock or grip of a firearm, the recoil pad comprising an elastomeric body enclosing at least a first gas chamber and a second gas chamber, wherein a first gas pressure within the first gas chamber is different from a second gas pressure within the second gas chamber.

Embodiment 6: The recoil pad of Embodiment 5, further comprising at least one access port extending through a wall of the elastomeric body to the first gas chamber, the at least one access port configured to retain gas pressure within the first gas chamber and to allow selective pressurization and depressurization of the first gas chamber by moving gas into and out from the first gas chamber through the at least one access port.

Embodiment 7: The recoil pad of Embodiment 5 or Embodiment 6, further comprising at least one additional gas chamber enclosed within the elastomeric body.

Embodiment 8: The recoil pad of any one of Embodiments 5 through 7, wherein the recoil pad includes a base plate attached to the elastomeric body.

Embodiment 9: A firearm, comprising: a stock extending from a firing mechanism, the stock having an end configured to abut against shoulder of a person firing the firearm; and a recoil pad disposed on the stock or the grip, the recoil pad including an elastomeric body enclosing at least one gas chamber and having at least one access port extending through a wall of the elastomeric body to the at least one gas chamber, the at least one access port configured to retain gas pressure within the at least one gas chamber of the recoil pad during use of the firearm and to allow selective pressurization and depressurization of the at least one gas chamber by moving gas into and out from the at least one gas chamber through the at least one access port.

Embodiment 10: The firearm of Embodiment 9, wherein the recoil pad includes two or more discrete gas chambers, each gas chamber of the two or more discrete gas chambers having a respective access port for independently selectively pressurizing and depressurizing each of the two or more discrete gas chambers.

Embodiment 11: The firearm of Embodiment 10, wherein the two or more discrete gas chambers comprise four discrete gas chambers.

Embodiment 12: The firearm of any one of Embodiments 9 through 11, wherein the recoil pad includes a base plate attached to the elastomeric body.

Embodiment 13: The firearm of any one of Embodiments 9 through 12, wherein the recoil pad is configured to allow repeated attachment to and detachment from the end of the stock.

Embodiment 14: The firearm of any one of Embodiments 9 through 13, wherein the recoil pad includes at least one aperture extending through the recoil pad, and wherein the recoil pad is attached to the end of the stock using a fastener extending through the aperture and into the stock.

Embodiment 15: The firearm of any one of Embodiments 9 through 14, wherein the firearm comprises one of a shoulder firearm and a handgun.

Embodiment 16: A firearm, comprising: a stock or grip extending from a central body comprising a firing mechanism, the stock or grip configured to abut against a body of a person firing the firearm; and a recoil pad disposed on the stock or the grip, the recoil pad including an elastomeric body enclosing at least a first gas chamber and a second gas chamber, wherein a first gas pressure within the first gas chamber is different from a second gas pressure within the second gas chamber.

Embodiment 17: The firearm of Embodiment 16, further comprising at least one access port extending through a wall of the elastomeric body to the first gas chamber, the at least one access port configured to retain gas pressure within the first gas chamber and to allow selective pressurization and depressurization of the first gas chamber by moving gas into and out from the first gas chamber through the at least one access port.

Embodiment 18: The firearm of Embodiment 16 or Embodiment 17, further comprising at least one additional gas chamber enclosed within the elastomeric body.

Embodiment 19: The firearm of any one of Embodiments 16 through 18, wherein the recoil pad includes a base plate attached to the elastomeric body.

Embodiment 20: A method of manufacturing a recoil pad for attachment to a stock or grip of a firearm, the method comprising: forming an elastomeric body enclosing at least one gas chamber; and providing at least one access port extending through a wall of the elastomeric body to the at least one gas chamber, the at least one access port configured to retain gas pressure within the at least one gas chamber of the recoil pad and to allow selective pressurization and depressurization of the at least one gas chamber by moving gas into and out from the at least one gas chamber through the at least one access port.

Embodiment 21: The method of Embodiment 20, further comprising forming the recoil pad to include two or more discrete gas chambers.

Embodiment 22: The method of Embodiment 21, further comprising providing each gas chamber of the two or more discrete gas chambers with a respective access port for independently selectively pressurizing and depressurizing each of the two or more discrete gas chambers.

Embodiment 23: The method of any one of Embodiments 20 through 22, further comprising attaching a base plate to the elastomeric body.

Embodiment 24: A method of manufacturing a recoil pad for attachment to a stock or grip of a firearm, the method comprising: forming an elastomeric body enclosing at least a first gas chamber and a second gas chamber; pressurizing the first gas chamber to a first gas pressure; and pressuring the second gas chamber to a second gas pressure different from the first gas pressure in the first gas chamber.

Embodiment 25: The method of Embodiment 24, further comprising providing at least one access port through a wall of the elastomeric body to the first gas chamber, the at least one access port configured to retain gas pressure within the first gas chamber and to allow selective pressurization and depressurization of the first gas chamber by moving gas into and out from the first gas chamber through the at least one access port.

Embodiment 26: The method of Embodiment 24 or Embodiment 25, further comprising attaching a base plate to the elastomeric body.

Embodiment 27: A method of manufacturing at least a portion of a firearm, comprising: providing a recoil pad including an elastomeric body enclosing at least one gas chamber and having at least one access port extending through a wall of the elastomeric body to the at least one gas chamber, the at least one access port configured to retain gas pressure within the at least one gas chamber of the recoil pad and to allow selective pressurization and depressurization of the at least one gas chamber by moving gas into and out from the at least one gas chamber through the at least one access port; and attaching the recoil pad to a stock or grip of a firearm.

Embodiment 28: A method of manufacturing at least a portion of a firearm, comprising: providing a recoil pad including an elastomeric body enclosing at least a first gas chamber and a second gas chamber, wherein a first gas pressure within the first gas chamber is different from a second gas pressure within the second gas chamber; and attaching the recoil pad to a stock or grip of a firearm.

Embodiment 29: A method of using a firearm, comprising: selectively pressurizing or depressurizing at least one gas chamber within a recoil pad on a stock or grip of a firearm; and abutting the recoil pad against a shoulder of a person and firing the firearm.

Embodiment 30: The method of Embodiment 29, further comprising: increasing or decreasing a gas pressure within the at least one gas chamber after firing the firearm; and abutting the recoil pad against a shoulder of a person and again firing the firearm.

The example embodiments of the disclosure described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosure, in addition to those shown and described herein, such as alternate useful combinations of the elements described, will become apparent to those skilled in the art from the description. Such modifications and embodiments are also intended to fall within the scope of the appended claims.

What is claimed is:

1. A firearm comprising:

a stock or grip extending from a firing mechanism, the stock or grip configured to abut against a body of a person firing the firearm;

at least one base plate; and a recoil pad comprising:

a single unitary elastomeric body having a plurality of interior surfaces defining two or more discrete gas chambers within the single unitary elastomeric body, the single unitary elastomeric body abutting directly against the at least one base plate, wherein an exterior surface of the single unitary elastomeric body forms at least a portion of an exterior surface of the recoil pad;

two or more access valves, wherein each access valve of the two or more access valves extends through a wall of the single unitary elastomeric body to a respective gas chamber of the two or more discrete gas chambers and is configured to retain gas pressure within the respective gas chamber of the two or more discrete gas chambers of the recoil pad and to allow selective pressurization and depressurization of the respective gas chamber by moving gas into and out from the respective gas chamber of the two or more discrete gas chambers through the access valve; and wherein a first gas pressure within a first gas chamber of the two or more discrete gas chambers is different from a second gas pressure within a second gas chamber of the two or more discrete gas chambers.

2. The firearm of claim 1, wherein the two or more discrete gas chambers comprise four discrete gas chambers.

3. The firearm of claim 1, the recoil pad further comprising at least one recess extending at least partially through the single unitary elastomeric body, wherein the at least one recess at least partially isolates individual gas chambers of the two or more discrete gas chambers from one another within the single unitary elastomeric body.

4. The firearm of claim 1, wherein the two or more discrete gas chambers comprise an upper left gas chamber, an upper right gas chamber, a lower left gas chamber, and a lower right gas chamber.

5. A firearm, comprising:

a stock or grip extending from a firing mechanism, the stock or grip configured to abut against a body of a person firing the firearm;

a recoil pad disposed on the stock or grip, the recoil pad including an elastomeric body enclosing two or more discrete gas chambers and having a plurality of access valves, each gas chamber of the two or more discrete gas chambers having a respective access valve of the plurality of access valves for independently selectively pressurizing and depressurizing each of the two or more discrete gas chambers, the plurality of access valves extending through a wall of the elastomeric body to the two or more discrete gas chambers, the plurality of access valves configured to retain gas pressure within the two or more discrete gas chambers of the recoil pad during use of the firearm and to allow selective pressurization and depressurization of the two or more discrete gas chambers by moving gas into and out from the two or more discrete gas chambers through the plurality of access valves; and wherein a first gas pressure within a first gas chamber of the two or more discrete gas chambers is different from a second gas pressure within a second gas chamber of the two or more discrete gas chambers.

6. The firearm of claim 5, wherein the two or more discrete gas chambers comprise at least one upper gas chamber and at least one lower gas chamber, and wherein the at least one upper gas chamber is at least partially separated from the at least one lower gas chamber by at least one linear recess.

7. The firearm of claim 5, wherein the two or more discrete gas chambers comprise four discrete gas chambers.

8. The firearm of claim 5, wherein the recoil pad includes at least one base plate attached to the elastomeric body.

9. The firearm of claim 5, wherein the recoil pad is configured to allow repeated attachment to and detachment from the stock or the grip.

10. The firearm of claim 5, wherein the recoil pad includes at least one aperture extending through the recoil pad, and wherein the recoil pad is attached to the stock or the grip using a fastener extending through the aperture and into the stock or the grip.

11. The firearm of claim 5, wherein the firearm comprises one of a shoulder firearm and a handgun.

12. A method of manufacturing a recoil pad for attachment to a stock or grip of a firearm, the method comprising:

forming an elastomeric body enclosing two or more discrete gas chambers;

providing a plurality of access valves, each gas chamber of the two or more discrete gas chambers having a respective access valve of the plurality of access valves for independently selectively pressurizing and depressurizing each of the two or more discrete gas chambers, the plurality of access valves extending through a wall of the elastomeric body to the two or more discrete gas chambers, the plurality of access valves configured to retain gas pressure within the two or more discrete gas chambers of the recoil pad and to allow selective pressurization and depressurization of the two or more discrete gas chambers by moving gas into and out from the two or more discrete gas chambers through the plurality of access valves; and pressurizing a first gas chamber of the two or more discrete gas chambers to a first pressure and pressurizing a second gas chamber of the two or more discrete gas chambers to a different second pressure.

13. The method of claim 12, wherein the two or more discrete gas chambers comprise an upper right gas chamber, an upper left gas chamber, a lower right as chamber, and a lower left as chamber, the elastomeric body further comprising a first linear recess separating the upper right gas chamber and lower right gas chamber from the upper left gas chamber and lower left gas chamber; and a second linear recess separating the upper right gas chamber and upper left gas chamber from the lower right gas chamber and lower left gas chamber.

14. The method of claim 12, further comprising providing each gas chamber of the two or more discrete gas chambers with a respective access valve for independently selectively pressurizing and depressurizing each of the two or more discrete gas chambers.

15. The method of claim 12, further comprising attaching a base plate to the elastomeric body.

16. A method of manufacturing at least a portion of a firearm, comprising:

providing a recoil pad including an elastomeric body enclosing two or more discrete gas chambers and having a plurality of access valves, each gas chamber of the two or more discrete gas chambers having a respective access valve of the plurality of access valves for independently selectively pressurizing and depressurizing each of the two or more discrete gas chambers, the plurality of access valves extending through a wall of the elastomeric body to the two or more discrete gas chambers, the plurality of access valves configured to retain gas pressure within the two or more discrete gas chambers of the recoil pad and to allow selective pressurization and depressurization of the two or more discrete gas chambers by moving gas into and out from the two or more discrete gas chambers through the plurality of access valves;

attaching the recoil pad to a stock or grip of a firearm; and pressurizing a first gas chamber of the two or more discrete gas chambers to a first pressure and pressurizing a second gas chamber of the two or more discrete gas chambers to a different second pressure.

* * * * *

UNITED STATES PATENT AND TRADEMARK OFFICE

CERTIFICATE OF CORRECTION

PATENT NO. : 9,021,727 B2
APPLICATION NO. : 13/740742
DATED : May 5, 2015
INVENTOR(S) : Lawrence V. Butler It is certified that error appears in the above-identified patent and that said Letters Patent is hereby corrected as shown below:

In the claims:

| | | | |
|---|---|---|---|
| CLAIM 13, | COLUMN 12, | LINE 54, | change “as chamber,” to --gas chamber,-- |
| CLAIM 13, | COLUMN 12, | LINE 55, | change “as chamber,” to --gas chamber,-- |

Signed and Sealed this
Twelfth Day of January, 2016

Michelle K. Lee

Michelle K. Lee
*Director of the United States Patent and Trademark Office*